United States Patent [19]

Bell

[11] Patent Number: 4,834,121

[45] Date of Patent: May 30, 1989

[54] HAIR TREATING APPARATUS

[75] Inventor: Verna M. Bell, Old Hickory, Tenn.

[73] Assignee: International Health Technology, Nashville, Tenn.

[21] Appl. No.: 75,735

[22] Filed: Jul. 20, 1987

[51] Int. Cl.[4] ..... A45D 19/16

[52] U.S. Cl. ..... 132/272; 134/175; 134/180; 4/516

[58] Field of Search ..... 132/9; 128/65; 34/96; 134/175 X, 95, 172, 177, 180 X, 200, 515, 516 X, 517, 518, 519, 520, 523

[56] References Cited

U.S. PATENT DOCUMENTS

| | | | |
|---|---|---|---|
| 2,854,970 | 10/1958 | Nolan | 4/517 |
| 3,343,530 | 9/1967 | Solos et al. | 132/9 |
| 3,521,647 | 7/1970 | Mercer | 132/9 |
| 3,584,390 | 6/1971 | Barker | 132/9 |
| 3,636,961 | 1/1972 | John et al. | 132/9 |
| 3,653,376 | 4/1972 | Martin | 132/9 |
| 3,692,066 | 9/1972 | Fava | 132/9 |
| 3,863,651 | 2/1975 | Vaiano | 132/9 |
| 3,894,546 | 7/1975 | Nolan | 132/9 |
| 3,934,596 | 1/1976 | Suntheimer et al. | 132/9 |

*Primary Examiner*—Gene Mancene
*Assistant Examiner*—Adriene J. Lepiane
*Attorney, Agent, or Firm*—Paul M. Denk

[57] ABSTRACT

Automatic hair shampoo machines were the basis of my U.S. Pat. No. 3,521,647. It overcame the problems associated with prior automatic shampoo machines. One of the imperfections of my earlier hair shampooing apparatus was its washing action. Another one was that during the time the apparatus of U.S. Pat. No. 3,521,647 was in service, it became apparent that the use of liquid tanks or reservoirs imposed limitations on its use. Still another area subject to improvement was a lack of a hair drying apparatus. By improvements herein a hair shampoo machine is provided which can be used unattended. It has an improved washing action, uses no tanks, and incorporates a hair drying apparatus. The washing action has been improved by, among other things, manifolds mounted at definite angles to complement each other. The solution tanks have been eliminated and replaced by a system which injects quantities of hair treating solutions. The hair drying apparatus includes outlets in the bowl or cover of the machine.

10 Claims, 3 Drawing Sheets

HAIR TREATING APPARATUS

BACKGROUND OF THE INVENTION

This invention, in one of its aspects, pertains to automatic hair shampoo machines. In another of its aspects the invention pertains to improvements in the apparatus characterized in my earlier U.S. Pat. No. 3,521,647.

The invention which was the basis of my U.S. Pat. No. 3,521,647 overcame the problems associated with prior automatic shampoo machines, particularly those with scalp massaging devices, such as those described in U.S. Pat. Nos. 2,566,600, 2,854,969, 2,854,970 and 3,177,868. However my invention did have some disadvantages.

By eliminating scalp massaging devices, based on the discovery that the massaging action can be obtained by jets of solution moving across the head, I introduced into industrial channels automatic shampoo machines previously not commercialized. When commercialization of U.S. Pat. No. 3,521,647 was undertaken it became apparent that fixed headers operated in sequence did not produce the same scalp stimulation which the moving header did. Hence it was the moving header of U.S. Pat. No. 3,521,647 which was commercialized. As the commercialization progressed, certain unforseeable limitations slowly surfaced. It was not until after a large number of hair washings that it was found that in the machine of my previous patent the washing action was not quite that desired. The reason for this is an apogee-perigee effect which will be explained hereinafter. At this point it will suffice to point out that the apogee-perigee effect produces skips or gaps in spray, turbulent conditions, and coalescence of spray droplets, all of which inhibit the washing action.

It was assumed that if there were gaps or skips in spray, whatever the reason, detergent water surging across hair so skipped by spray would nevertheless wash it. Since to some extent this is true, the imperfect washing went unnoticed. When the flaw did become apparent, it was solved by moving the header swivel joint, or axis of rotation, above and outside the bowl. With the swivel connection outside the bowl so that the header oscillated about an axis through the head, and more or less parallel thereto, electrical and mechanical problems arose. It was difficult to keep water out of the drive mechanism, and hair out of the swivel joint.

Contrary to expectations increasing the pressure of solutions being sprayed does not improve the washing action. In addition too much pressure can be discomfortable. It can also lead to a turbulent condition. If the pressure is increased to obtain sufficient jet action for underneath washing, impingement on the scalp is too intense and turbulance can become too great. Thus, the washing power of my prior invention was subject to improvement, but such improvements did not come into being. It became apparent that the swivel joint had to be in the bowl. With the axis in the bowl solutions to the problem of imperfect washing could not be found. They are the subject of one aspect of this invention.

In another aspect of this invention, during the time the apparatus of U.S. Pat. No. 3,521,647 was in service, it became apparent that the use of tanks or reservoirs for hair treating solutions imposed severe limitations on the use of the apparatus. Shampoo reservoirs, such as those in my apparatus, and in U.S. Pat. Nos. 2,854,969, 2,854,970 and 2,185,495 are of limited capacity. This means that the shampoo tanks frequently had to be refilled. As a consequence the machines could not be left unattended. During all the years of use no solution could be found to the tank problem. As a result the machines have not been installed in nursing and retirement centers. In addition the type and hardness of water used in the machine imposed constraints on mixing the shampoo and water for use in the solution tanks. The mixing of hair treating solutions with water also required the attendant. Consequently my earlier invention was in need of improvement, but such improvements were not forthcoming. By the improvement herein a hair shampoo machine is provided which can be used unattended. I have solved the long-existing tank problem.

One other imperfection in my U.S. Pat. No. 3,521,647 apparatus was that no drying means was provided. In installations for senor citizens dryers are a necessity. With no attendant present, commercial drying units were not feasible. They are large, rather overwhelming, and somewhat complex. Lack of drying means was found to militate against the use of my automatic shampoo machines in health care and retirement centers. In still another aspect of this invention hair drying means have been incorporated in the automatic shampoo machine.

SUMMARY OF THE INVENTION

This invention contemplates improvements in my earlier apparatus for use in applying hair treating solutions to the human head. That apparatus included a bowl, a closure therefor, adapted to enclose the head in a substantially fluid-tight fit between the head and the bowl, with the face outside the closure. For the washing and massaging action a single oscillating arcuate header held by the bowl sides and having nozzles positioned thereon was employed to dispense adjacent sprays. Driving means inparted partial rotation to the arcuate header, moving the header in an arc from a perigee point close to the head at the forehead to an apogee point farthest from the head at the neck. Means were provided for conveying, from tanks to the header, water, and hair treating solutions to be sprayed under pressure on the hair.

One improvement was that of ameliorating the washing action of the apparatus by compensating for an apogee-perigee impairment of spray. A plurality of spray manifolds are employed, each mounted on a common spindle at an angle relative to another, the spindle being at the vertex of each angle between manifolds. Nozzles are mounted on each manifold. The nozzles on different manifolds are adapted to dispense sprays which complement each other in spraying a shower on the head from front to back. The nozzles on the same manifold are disposed at angles to dispense sprays which complement each other in spraying a shower on the head from side to side.

Another improvement involves eliminating apparatus solution tanks. Instead of tanks, an inlet water line, inlet water temperature control means, and inlet water pressure regulating means are provided. Flow lines connect the inlet water temperature control means, the pressure regulating means and the header, and means are included for injecting measured quantities of hair treating solutions into those flow lines.

By still another improvement, hair drying means are incorporated in the hair treating apparatus. An air blower is housed within the cabinet, and means controlling the air blower outlet air temperature are provided. Air conduit means convey the air from the blower to hair drying apparatus.

DETAILED DESCRIPTION OF THE INVENTION

The improvements constituting this invention can, perhaps, best be understood if my earlier apparatus is first described. That shampoo machine 2 is shown in FIG. 1. A cabinet 4 supported a bowl 6 having a drain 8 in its base. The bowl was provided with a neck rest so that a person faces upwardly as illustrated in FIG. 1. A top 10, was hinged to cover bowl 6 and close about the face. A flexible sealing edge or curtain 12 in a portion of the top kept hair treating compositions and water within the unit. To achieve the washing action an oscillating arcuate header 14 was provided. The solutions flowed through the nozzles 16 on the header. By oscillation of header 14, water, or other hair treating solutions, could be sprayed across the head by nozzles 16. In washing or rinsing, either water from a reservoir, or a premixed water-shampoo mix from another reservoir, or water and a conditioner from a third tank was pumped to the header. This invention is concerned, in part, with the washing action, and in part with the elimination of the tanks.

BRIEF DESCRIPTION OF THE DRAWINGS

I shall now refer to additional drawings for a complete understanding of my invention.

Figure 2:
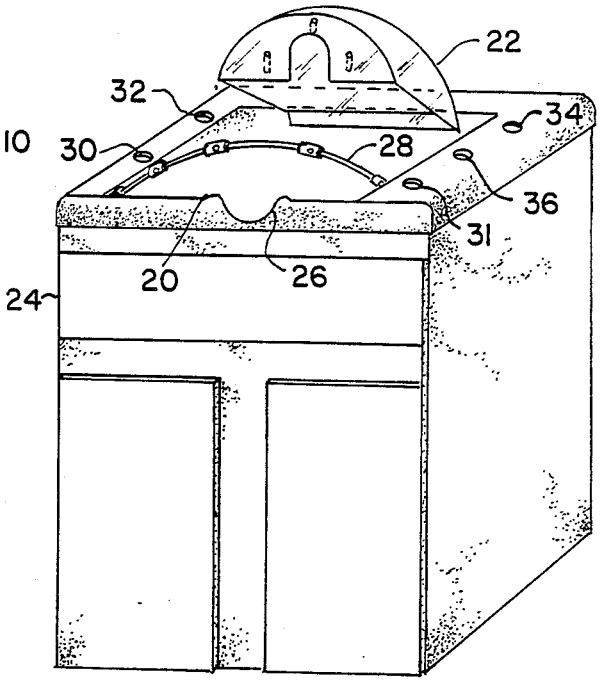
FIG. 2 is a perspective view of the improved machine of this invention.

Preliminarily, considering the general features of the invention, as shown in FIG. 2, the automatic hair shampoo apparatus includes a shampoo bowl 20 provided with a lid or cover 22, mounted in a cabinet 24. The neck rest is shown at 26. One of the two washing elements or manifolds 28 is visible. The other manifold 29 (FIG. 3) is disposed at an angle thereto as will be described. Control knobs 30, 32, 34 and 36 are also visible in FIG. 2.

Figure 1:
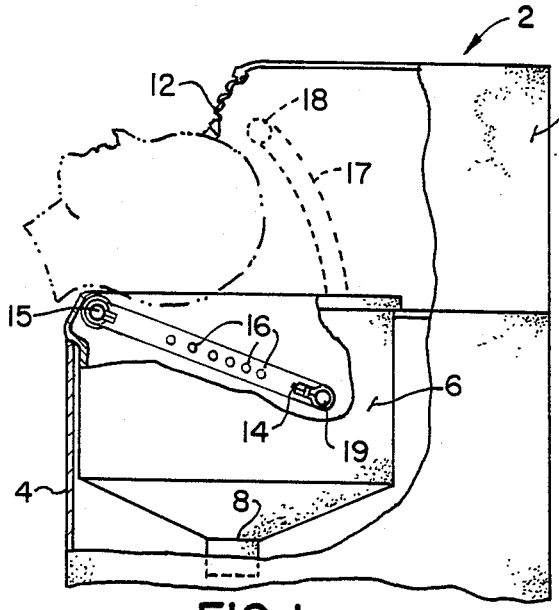
FIG. 1. PRIOR ART
FIG. 1, as indicated, is my prior art device.

Manifolds 28 and 29 (FIG. 3) oscillate about an axis or pivot point 35 so that they progress back and forth opposite the head as shown in FIG. 1.

It is the path of this oscillatory movement of manifolds which leads to problems. Since my prior device had a single header 14, FIG. 1 more clearly illustrates the arcuate path. Movement of a point a fixed distance about a point generates a circle. Likewise, driving header 14 about an axis 15 moves the header in a circular path 17. Since the person's head is not in the center of the circle there is a point 18 where the header is close to the head, its perigee, and a point 19 where the header is at its greatest distance from the head, its apogee.

Figure 5:
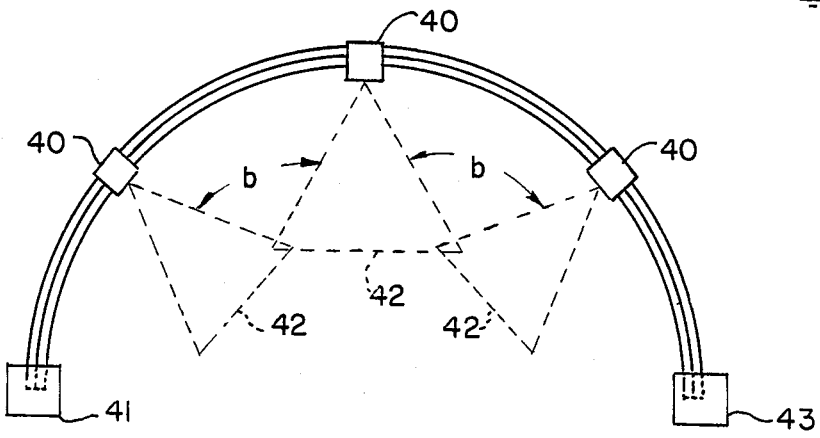
FIG. 5 is a diagrammatic representation of a spray manifold.

Spray nozzles are designed to dispense either fan shaped or cone shaped sprays certain maximum distances from their nozzle orifices. For example, consider a nozzle having a given flow capacity and orifice size, ejecting a 60 degree angle spray at a given pressure. This cone or fan spray, as the case may be, will be of a given size. Beyond that maximum cone or fan width particles will coalesce and lose their spraying effectiviness, scattering as large drops. This effect enters into the apogee-perigee movement of the spray header in an automatic shampoo machine. While it is true that a single nozzle may have a range sufficient to accommodate the apogee-perigee position of the nozzle, it must be remembered that spray across the head is required. Hence spray from one nozzle must coact with spray from an adjacent nozzle. For a better understanding of this aspect of the invention reference is made to FIG. 5. An overlapping of sprays from adjacent nozzles is shown in that figure. In FIG. 5 a fan or cone spray is shown as a dotted triangle 42. It will be noted that only the corners of these triangles overlap. The size of the spray at a given pressure is a function of nozzle design. That maximum size, and the distance of the nozzles from each other, can be controlled to maintain a minimal spray overlap. A greater degree of overlap results in excessive turbulance, in the area just below that depicted. Beyond that, there is a loss of jet action through coalescence of spray drops. Consequently spray size, the distance between nozzles, and the manifold angles are correlated herein.

At the operating pressure spray overlapping is a function of the spray size and the distance of the manifolds from the head. Referring again to FIG. 5, the theoretical triangle 42 is a depiction of the most efficient area, or maximum size, of the spray of that nozzle. Washing action is maximized if the top of the head is at the base of theoretical triangle 42, therefore at the edge of the most efficient area of spray. This criterion can be readily met given the design of the nozzle spray. It will be appreciated that if hair to be washed is beyond the base of the triangle it will be in either a turbulent or in a coalescent zone. It can be seen, on the other hand, that if hair is closer to the apex of triangle 42 it will be in an area where there are spaces b between sprays.

With this understanding of sprays, the apogee-perigee effect will now be considered. At perigee the hair could be so close to the manifold that gaps in washing would result due to the spaces b between sprays. This is true whether sprays are fan or cone shaped. At apogee, the hair is in either a turbulent or a coalescent area, neither of which are as effective as the area of overlap depicted in FIG. 5. In accordance with the practice of this invention the apogee-perigee problem has been solved by the use of more than one manifold, and by complementary spray nozzles. With more than one manifold, one can be set for the perigee condition, and one can be set for the apogee position.

The manifolds are at apogee at the bottom of the oscillatory cycle, that is near the neck. If both manifolds were designed with the ideal condition at apogee, there would be gaps at perigee. Stated differently, as the manifolds traverse toward the forehead, nearing the top of the oscillatory cycle, the hair will be so close to the nozzles that it will be in the zone in which spaces b exist between sprays. See FIG. 5. To remedy this situation the manifolds are set so that an area washed by the upper manifold is also washed by the lower manifold. This is the reason the angle between the manifolds is important. It can be seen that the nozzles on one manifold complement those on the other manifold so the hair is showered from front to back, that is, from the forehead to the neck. It is to be noted that nozzles on the same manifold also coact. They are disposed at angles which form overlapping sprays, complementing each other in spraying a shower on the head from side to side.

To take advantage of the washing of one area by spray from both manifolds, each nozzle on the upper manifold is adapted to dispense a spray having its maximum width at the top of the cycle, close to the forehead, at perigee. By maximum width I mean the condition shown in FIG. 5, wherein beyond the overlap turbulence or coalescence occur.

Continuing, each nozzle on the lower manifold is adapted to dispense a spray having its maximum width farthest from the head, at apogee. This would be at the bottom of the cycle opposite the neck. With this arrangement, the area sprayed by nozzles on the upper manifold, which spray begins to deteriorate, is also sprayed by the lower manifold. In order to accomplish this, the angle between the manifolds is controlled. The angle between the manifolds is shown as angle a in FIG. 3. In order to spray the same area with spray from both manifolds angle a should be between 60 and 80 degrees, desirably between 65 and 75 degrees.

As pointed out, spray nozzles 40 on manifolds 28 and 29 can discharge a cone or a fan spray. A fan spray is preferred herein so that sheets of water will result, sheets in the sense that a sheet is very thin in relation to its length and breadth. Since the sheet is shaped like a fan, the spray is known as a fan spray. Fan sprays from the nozzles not only create sheets of water, but they create less turbulance. Again it will be appreciated that nozzle angles must be such that sprays from adjacent nozzles slightly overlap.

Figure 6:
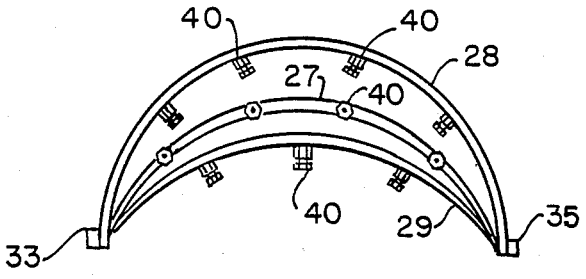
FIG. 6 is a diagrammatic view of a three manifold spray header.

Ideally three manifolds 27, 28 and 29, shown in FIG. 6, can be employed. Spray from the third manifold can have a maximum width between those emanating from nozzles on the other two manifolds. It can be seen that the number of manifolds, and the number of nozzles on each manifold are not fixed. Since the head narrows at the neck fewer nozzles can be used on the lower manifold. We prefer three nozzles closer together on that manifold, and four farther apart on the upper manifold. Additional nozzles and manifolds can be used, but pressure requirements, cost, and turbulance are increased thereby.

Before leaving the nozzles to discuss the operation of the apparatus, two special nozzles should be mentioned. In order to wash the sideburn area, the two outer nozzles on the upper manifold are specifically directed to that area, and the nozzles are designd to properly impinge upon it. Preferably these are cone shaped spray dispensing nozzles.

To further clarify the features of this invention, specific operational details will now be given. In general these include a manifold drive means and the hydraulic and electrical systems. Each of these will now be described separately.

Partial rotation or oscillation of the manifold unit can be accomplished electrically or hydraulically as it was in my earlier machine. By manifold unit I mean that two or more manifolds joined on a common axis. As suggested in my prior patent, either a turbine wheel or an electric motor can be used to drive a crank arm. The use of reduction gears and bell crank arms are well known means for achieving oscillation. Hence they need not be specifically discussed herein. The innovation in this improved machine is that a port in the bowl, preferably with a sleeve bearing within it, serves as the bearing for the manifold journal. Such a close fitting swivel joint makes it unlikely that long hair will catch in the swivel joint as was previously the case. In addition, herein all of the drive means is under the bowl away from any water. Desirably a long crank arm is employed so that the motor is in the back of the cabinet.

Figure 3:
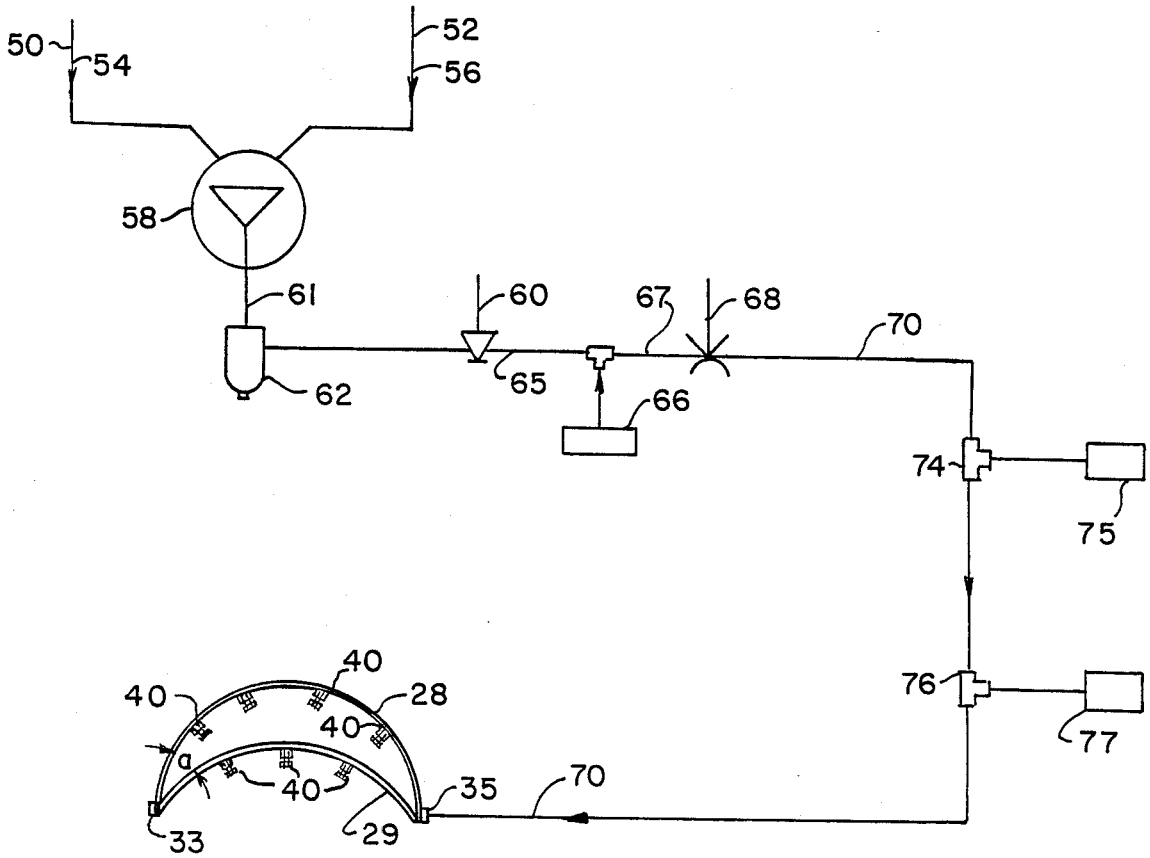
FIG. 3 is a diagrammatic representation of the hydraulic system incorporated in my improved apparatus.
Figure 4:
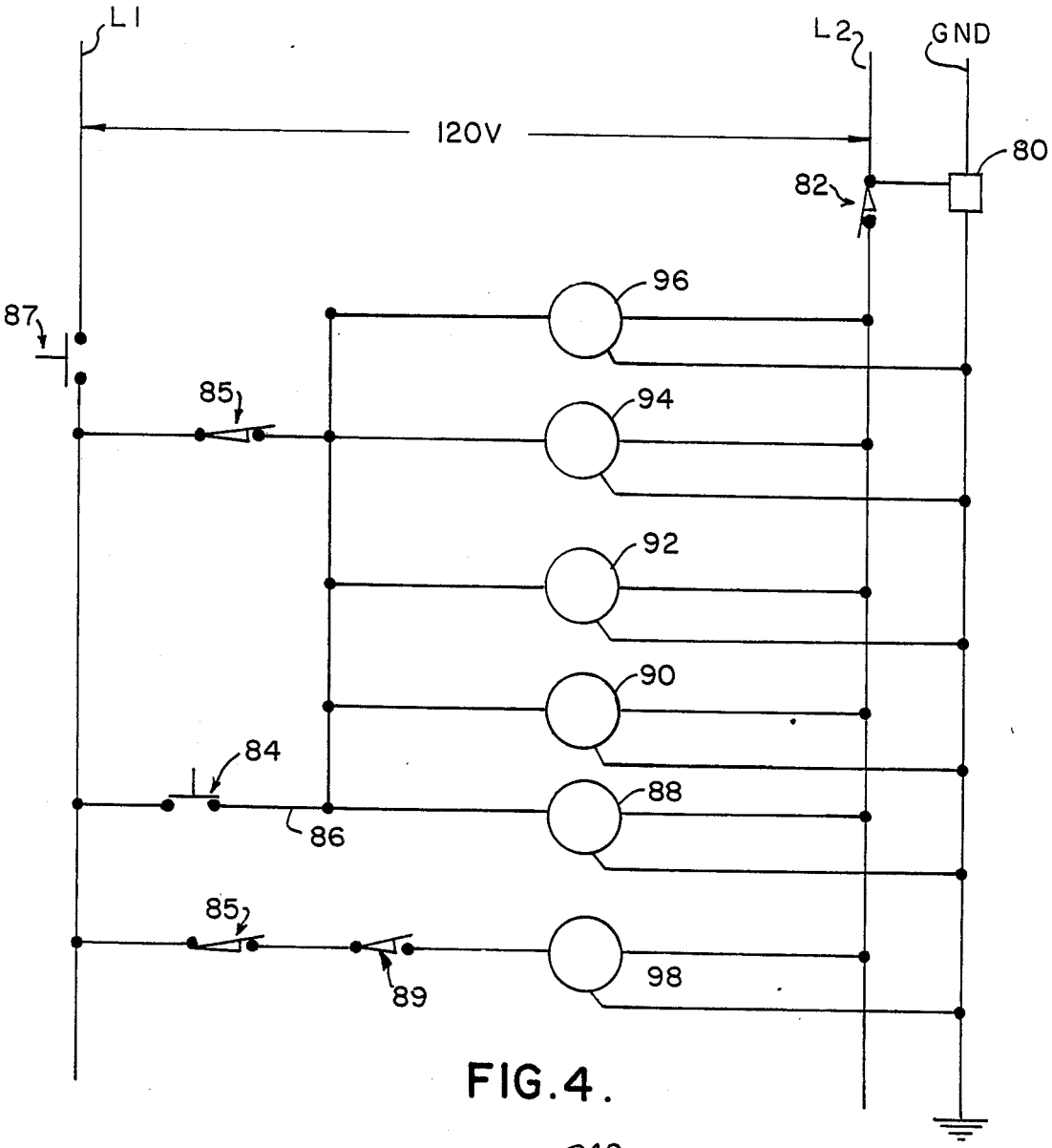
FIG. 4 is a diagram of the preferred electrical system for controlling my new hair shampoo machine.

The hydraulic system is illustrated in FIG. 3, and a diagram of the electrical system is shown as FIG. 4. The explanation of the hydraulic system will be given in terms of water flow. Apart from electrical controls, the operation of the hair shampoo apparatus will become clear by following the flow of water.

Referring now to FIG. 3, hot water 50 and cold water 52 enter the shampoo machine through lines 54 and 56 respectively. These flow into a pressure balancing cycle valve 58. This balancing cycle valve is a constant temperature device which maintains an incoming water temperature within two degrees of a set temperature, in this instance 105 F. Flow into balancing cycle valve 58, and hence throughout the system, is controlled by a solenoid valve 60. Before passing through solenoid valve 60, the incoming water in hydraulic line 61 from the balancing cycle valve 58 passes through a water filter 62. To increase the pressure of the incoming water to a pressure within a range better suited to the action of washing manifolds 28 and 29, for example 80 to 120 psi, water line 65 conducts the water to pump 66. The output from this pressure pump flows through line 67 to pressure regulator 68. From the pressure regulator, the water, now at the desired temperature and pressure, flows through line 70 and full pressure swivel joint 35 to manifolds 28 and 29.

As discussed previously, heretofore tanks have been employed. For example, in my earlier device one tank contained water; one tank contained a water-shampoo mixture; and a third tank held a conditioner-water mix. Such tanks are shown not only in my prior patent, but in others as well. In accordance with this invention such tanks have been eliminated. By this improvement a metering pump 74 is inserted in line 70. Metering pumps are widely used in industry. For instance they are employed in the chemical processing, petroleum refining, wood pulp and paper processing industries. Such uses have included cooling towers, boiler water, system flushing and process water treatment. Those uses are quite foreign to my use. Unexpectedly I found that the shampoo tank problem, existing since the issuance of my patent is 1970, could be solved by such a metering system. The quantity of shampoo necessary for any water hardness can be injected into the system by adjusting the flow characteristics of the pump. Any of the various known metering pumps can be used, either the aspirator or the plunger types. In plunger types silicon-controlled rectifier (SCR) circuits can be used to vary the pump output. Pneumatic power and electrical metering pumps with solenoids can also be used. It will be appreciated that even though shampoo is injected into line 70 by metering pump 74 (90 in FIG. 4) from a vessel 75, this vessel normally will be the container in which shampoo is sold. The frequent filling of tanks is unnecessary. The ratio of water to shampoo in line 70 is so great that container 75 has a long life. Moreover it can be simply replaced by attaching a refill. The maintenance will be akin to keeping paper in a copy machine. This will be even more true when conditioners and other treating solutions are dispensed from container 77 by metering pump 76 (88 in FIG. 4). In addition no rinse water tank is required.

Having explained the hydraulic system I shall now described the electrical system. The system is an essentially parallel circuit which includes current line L1, common line L2, and ground line, gnd, as shown in FIG. 4. When the machine is in operation, master switch knob 36, FIG. 2, and 87, FIG. 4 will be closed.

To permit component replacement in the electrical system, and to minimize downtime, a modular design is preferred. In addition since use of my invention in nursing and retirement homes is contemplated, a failsafe electrical system is provided so that there is no possibility of electrical shock. To this end a ground fault interrupter is employed. Input power or incoming current in line L1 is responsive to a ground fault interrupter 80. This component is a detector or fast acting circuit breaker which senses very small ground line current. In order to detect any short in the system, whether due to water, a malfunctioning or defective component, this ground fault detector is used. The component preferred for use herein is a solid state module which detects a system leak greater than 5 miliamps in the ground wire. If it does, switch 82 is opened, shutting down the system.

To energize the components in the system, start button 30, FIG. 2, closes switch 84, FIG. 4. Line 86 then carries incoming current to a starting-current surge limiter. This is relay or surge arrester. A preferred arrester is definite purpose contactor 88 which employs suppression components with nanosecond reaction time to provide high speed protection of the modules in the circuit following it. In the event of an initial or transient power surge, the starting-current surge limiter protects components by maintaining the current at their operating level. Transients are prevented from reaching the component AC input.

At the time start button 84 is depressed, the timer switch 32 is also set. Timer switch 32 includes two cam, upper and lower switches, designated 85' and 85'' in FIG. 4. Start button 84 is normally open. Setting the timer closes upper cam switch 85' in FIG. 4 so that AC output from the starting-current surge limiter energizes all of the components needed in the hydraulic system. Thus the manifold oscillating motor 90, the water temperature balancing valve 92, and the water pump 96 are all energized. The water temperature balancing valve 92 is a normally closed valve. When the coil of its solenoid 92 is energized, valve 58 (FIG. 3) opens, and water begins to flow. At the same time the water pressure control motor 96 is activated so that the desired system water pressure is obtained. Concomitantly oscillating motor 90 is actuated, driving the spray nozzles.

To consider the operation, refer again to the four knobs on top of the machine. The timer, upper and lower cam switches 85, is set with knob 32. The length of the soap cycle, switch 89, is set with knob 34 which starts shampoo pump 98. And the definite purpose contactor is energized with start button 30, switch 84. The fourth knob 36 is master switch 87 seen in FIG. 4.

With the electric system activated as described the hydraulic system is put into operation. Water will flow through the oscillating manifolds until cam switch 85 of timer 94 is closed. This energizes the metering pump 74. Additional metering pumps such as 76 will be brought into operation in the same way by additional cam switches in the timer switch. The preferred metering pump is provided with an interrupt switch 89 which sets the length of the metering cycle. This setting of the length of soap injection is accomplished by knob 34. In order to adjust the quantity of shampoo or other liquid injected into the system, for example based on water hardness as discussed, our preferred metering pump is provided with a mode selector, not shown.

As noted hereinbefore, our shampoo machine has been further improved by the incorporation therein of hair drying means. My hair drying feature is especially desirable when the shampoo apparatus is to be used in hospitals, nursing homes, and retirement centers.

Figure 7:
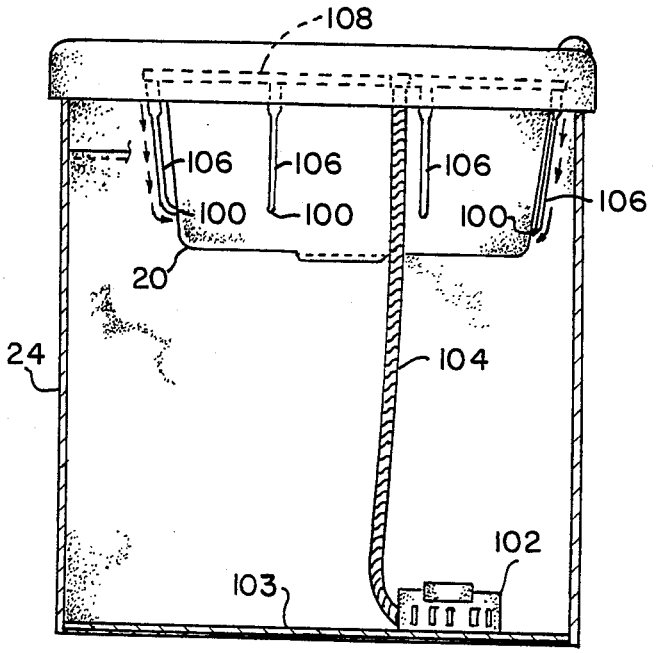
FIG. 7 is an elevation view showing the hair drying means of the invention.
Figure 8:
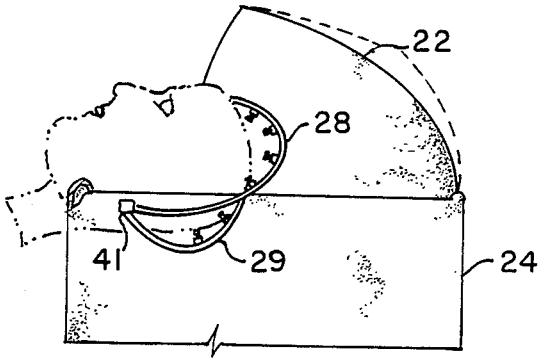
FIG. 8, partially diagrammatic, shows the position of the manifold vertex relative to the head.

The spray manifolds do not have the capacity for carrying the quantity of air required for drying. But there are other embodiments of this aspect of my invention. One embodiment is shown in FIG. 7. In this embodiment orifices are provided in the periphery of bowl 20 as seen at 100 in the figure. An air blower 102, adapted with means to control the air outlet temperature in response to switch 31 (FIG. 2), is attached to the inside bottom 103 of cabinet 24. Air conduit means 104 are provided for conveying air from blower 102 to the drying apparatus, which includes the bowl and the cover therefor. In the bowl, orifices are provided in the periphery thereof. Means must also be provided to prevent any water in the bowl from entering air conduit means 104. I prefer downpipes 106 extending upwardly above the water level. The lower ends of downpipe 106 are secured at 100 to the orifices in bowl 20 in order to admit drying air into the bowl. The open upper ends of downpipes 106 are attached to openings in manifold 108. Since the air conduit line 104 is also joined to manifold 108, the drying air flows out the orifices into the bowl.

In another embodiment of the drying means, a dryer bonnet is adapted to be held within and to be withdrawn from inside the cabinet. Air conduit means 104 can also be retractable tubing. It can be stretched during use, but draw up when released. Spring recoiling mechanisms are also available. To operate the dryer, timer switch 94 is provided with an additional cam. When the blower is actuated, air will surge through the air conduit means to the bonnet.

In the light of the teachings of this invention variations and modifications will occur to those skilled in this field. As indicated, variations are possible in the number and position of manifolds, and in the location and type of nozzle. This is also true of the manifold drive means. Oscillatory movement, whether electrically or hydraulically, can be obtained by a variety of drive mechanisms. In still another modification the location of the axis of manifold rotation is subject to some latitude. Note that in FIG. 1 it is under the neck. We have found it to be better if it is at the earline. In other words, journals 41 and 43, FIG. 5, are opposite the ears. It is also to be appreciated that the manifold unit can be journaled at only one end, say 41, with the other end pivoting freely at 43. Considerable latitude is also possible in incorporating the hair drying apparatus. For instance, instead of manifold 108, a series of individual air conduits stemming from air conduit 104 can be connected to each downpipe 106. Moreover, various water traps are available for use instead of downpipes. In another variation the shampoo machine cover 22 can carry the drying air dispensing means. Since such ramifications will occur to those working in this field they are deemed to be within the scope of this invention.

What is claimed is:

1. In apparatus for use in applying hair treating solutions to the human head, which includes a bowl, a closure therefor adapted to enclose the head in a substantially fluid-tight fit between the head and the bowl, with the face outside the closure, a single oscillating arcuate header held by the bowl sides, and having nozzles thereon to dispense sprays, driving means partially oscillating the arcuate header to move the header in an arc from the forehead to the neck, and means for conveying hair treating solutions to the header to be sprayed under pressure on the hair, the improvement ameliorating the washing action of the apparatus including a plurality of spray manifolds, each mounted on a common spindle at an angle relative to the other, the spindle being at the vertex of each angle between upper and lower spray manifolds, manifold drive means imparting partial manifold rotation about the spindle so that manifolds travel along the head to dispense spray from the forehead to the neck, means for attaching the manifolds to the spindle so that an upper manifold is at a perigee point closest to the head at the forehead, and such that a lower manifold is at an apogee point farthest from the head at the neck, spray means on the upper manifold adapted to dispense a spray having its maximum width at perigee, with spray impairment at apogee, spray means on the lower manifold adapted to dispense spray having its maximum width at apogee, with spray impairment at perigee, means for attaching the spray means on the spray manifolds so that sprays from adjacent spray means overlap each other, and cam means urging the manifolds past the spray impaired apogee and perigee points during oscillation so that spray from both upper and lower manifolds showers those points, this double showering compensating for the impairment of spray on those areas of the head.

2. The hair treating apparatus of claim 1 including three manifolds, an upper manifold, a middle manifold, and a lower manifold, spray means on the upper manifold adapted to dispense spray having its maximum width at perigee, spray means on the middle manifold adapted to dispense spray having its maximum width between perigee and apogee, spray means on the lower manifold adapted to dispense spray having its maximum width at apogee, and means connecting the three manifolds so that spray showers portions of the head which adjacent manifolds shower on oscillatory movement of the manifolds.

3. The hair treating apparatus of claim 1 including two manifolds and means connecting the two manifolds at an angle such that during upward oscillatory movement spray from the lower manifold showers portions of the head which the upper manifold showers.

4. The hair treating apparatus of claim 1 wherein the improvement ameliorating the washing action includes an electrical system with a grounding circuit and a hydraulic system with incoming water lines.

5. The hair treating apparatus of claim 4 wherein the hydraulic system includes a balancing cycle valve controlling water temperature in the incoming water lines.

6. The hair treating apparatus of claim 4 wherein the hydraulic system includes a pressure regulator.

7. The hair treating apparatus of claim 4 wherein the hydraulic system includes hydraulic manifold drive means.

8. The hair treating apparatus of claim 4 wherein the electrical circuit includes a ground fault interrupter.

9. The hair treating apparatus of claim 4 wherein the electrical circuit includes a current surge limiter.

10. The hair treating apparatus of claim 4 wherein the electrical circuit includes electric manifold drive means.

* * * * *